United States Patent [19]

Ray

[11] 4,368,608

[45] Jan. 18, 1983

[54] AUTOMATIC ICE BAGGER

[75] Inventor: Jimmy C. Ray, Denison, Tex.

[73] Assignee: Texas Aim, Inc., Houston, Tex.

[21] Appl. No.: 818,506

[22] Filed: Jul. 25, 1977

[51] Int. Cl.[3] ..... B65B 5/06; B65B 63/08

[52] U.S. Cl. ..... 53/440; 53/469; 53/127; 53/572; 53/385

[58] Field of Search ..... 53/25, 29, 127, 189, 53/385, 440, 469, 572

[56] References Cited

U.S. PATENT DOCUMENTS

| | | | |
|---|---|---|---|
| 3,009,336 | 11/1961 | Bayston et al. | 62/344 |
| 3,075,324 | 1/1963 | Burks et al. | 53/29 |
| 3,789,570 | 2/1974 | Mullins | 53/29 |

*Primary Examiner*—John Sipos
*Attorney, Agent, or Firm*—Wendell Coffee

[57] ABSTRACT

A measured amount of water is frozen in a tray and cubed. The cubes are dropped directly into a bag placed under a chute. The ice drops responsive to the defrosting of the tray which releases the cubes. When the defrosting cycle of the ice maker is complete the tray moves up which moves an attached chain up to unclog any ice jam in the chute. Then the freezing of the ice begins again, a bag-carrying platen moves away from the chute and the bag is heat sealed. The bag, full of ice, is then released and dropped into a cold storage bin below the bagging mechanism.

16 Claims, 9 Drawing Figures

AUTOMATIC ICE BAGGER

BACKGROUND OF THE INVENTION

1. Field of the Invention

This invention relates to bagging or packaging ice wherein the ice is packaged immediately after freezing.

2. Description of the Prior Art

Before my invention, there were machines commercially available (such as those manufactured by Koldraft Div. of Uniflow Manufacturing Company, Erie, Pa. under U.S. Pat. Nos. 3,009,336 and 3,654,771) wherein a pre-measured amount of water was frozen, cubed, and dumped in bulk. Each freezing cycle froze a preset amount of water, and, therefore, each freezing cycle produced the same weight of ice.

Also, before my invention, there were U.S. patents for bagging ice and other material.

For example, Zimmerman, U.S. Pat. No. 3,151,668, disclosed a coinoperated bagger wherein upon activation of the machine, a measured aomount of ice would be augered into a chute leading to a bag. The ice reached the auger from a storage bin which had stirring rods therein to keep the ice from freezing together. The ice was pre-frozen and dumped into the bulk storage bin. Sacks were fed from a roll to a position under the chute where the ice would be caught.

Lamka et al., U.S. Pat. No. 3,712,019, discloses a machine where ice from a bulk storage is augered into three measuring columns. The measuring columns are mounted on a rotating head. The columns are indexed to a dumping chute where they are dumped into a bag. The top bag of a stack of bags is opened by an air blast to receive the measured amount of ice which is dumped each time one of the measuring bins is rotated over the chute. The bags are removed and enclosed otherwise.

Rowland et al., U.S. Pat. No. 3,913,343, discloses an ice machine wherein ice is augered upward from a bin of ice into a dumping chute. The machine is coin operated, and the machine dumps ice into a hand held receptacle.

McKenney et al., U.S. Pat. No. 3,807,193, discloses a coin operated bagging machine. The ice is maintained in a storage compartment with sloping walls. When a coin is inserted, a flap opens a bag which is positioned under a chute and when the bag is opened, the auger is actuated to place ice in the bag until the weight of the ice upon a grid wherein the bag is resting indicates a predetermined amount of weight. At that time, the auger motor is stopped and the bag of ice is removed by hand.

Feistel, Jr., U.S. Pat. No. 3,207,366, also discloses a coin operated machine wherein the ice is made in bulk and thereafter is measured as to volume. Upon insertion of a coin, a predetermined volume of ice is dispensed.

Merat, U.S. Pat. No. 3,851,444, discloses a heat-sealable bag mechanism.

Williams, U.S. Pat. No. 3,727,374, discloses a blower for blowing open the top of a plurality of bags to be filled.

SUMMARY OF THE INVENTION

(1) New and Different Function

I have invented an ice bagging machine providing a plurality of bags of preweighed ice which are stored for subsequent sale. According to my invention, immediately after the ice is frozen, it is bagged and the bag is hermetically sealed. By following this procedure, I am able to keep the product sanitary. It will be understood that ice is a food product. Even when stored in bins, it is subject to contamination.

Not only does my invention protect the sanitation of the product, but it also prevents detoriation of the ice. Those familiar with ice understand that ice will sublime and therefore a certain loss is experienced. Also, the ice tends to freeze together, so that if the ice is stored in bulk, it must be stirred and broken up before it is measured. Since my invention produces ice which is packaged for sale at the time of freezing, I eliminate all these problems, and, in addition, do away with any difficulty in measuring or weighing the ice precisely.

The prior art measures ice either by volume or by weight. According to my invention, the water is weighed before freezing; therefore, I am able to maintain more accurate quantity as well as quality control. Basically, I achieve the above by using a freezer which freezes a preweighed amount of water. When the ice is frozen, the freezing mechanism itself goes through designated cycles to begin defrosting the tray upon which the ice is frozen.

I use the beginning of the defrosting cycle as a signal to my bagging machine to move an empty bag under the chute wherein the ice is dumped. A platen moves forward to move a bag under the chute and a blower opens the bag. A clamp holds the open bag in position, and ice is dumped therein.

At the time the freezing cycle of the freezing unit begins again, the bag holder moves away and the top of the bag is sealed. After the sealing operation is completed, a trap door upon which the bag rests opens, dropping the bag into a cold storage bin.

Thus it may be seen that the total function is greater than the sum of the functions of the individual bags, motors, sprockets, etc.

(2) Objects of this Invention

An object of this invention is to bag ice.

Further objects are to achieve the above with a device that is sturdy, compact, durable, lightweight, simple, safe, efficient, versatile, sanitary, ecologically compatible, energy conserving, and reliable, yet inexpensive and easy to manufacture, install, adjust, operate and maintain.

Other objects are to achieve the above with a method that is versatile, sanitary, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
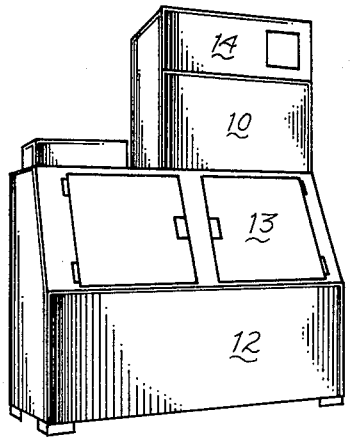
FIG. 1 is a perspective view of an embodiment of my invention on top of a cold storage bin with an ice maker mounted thereon.

Referring to FIG. 1, it may be seen that automatic ice bagger 10 is designed to be mounted upon the top of cold storage bin 12. Ice maker 14 is mounted upon the top of the ice bagger 10. It will be understood that the bin 12 need not be a separate enclosure, but that the entire bagger and ice maker 14 could be entirely enclosed in a large cold vault.

Figure 2:
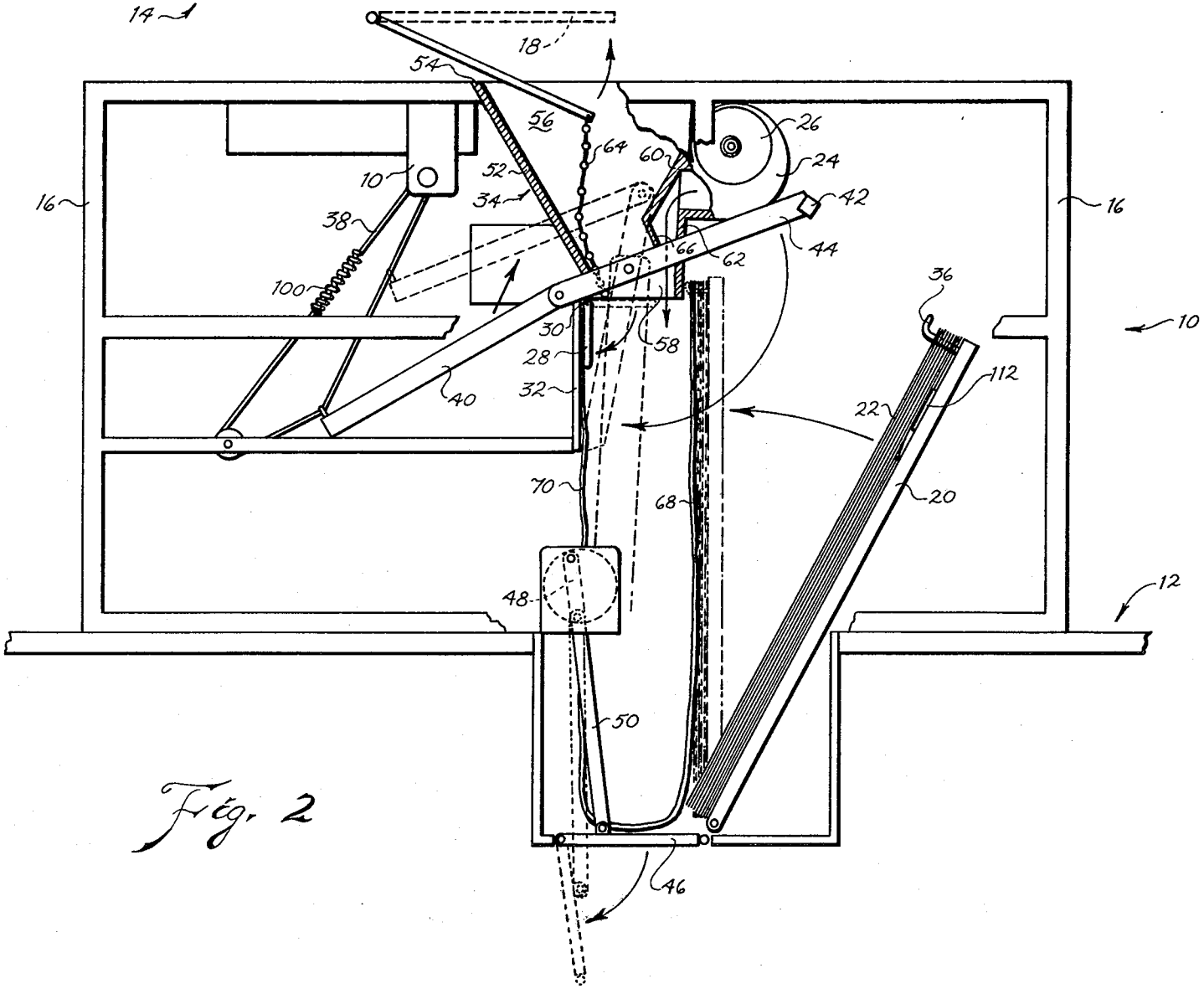
FIG. 2 is a side elevation view of the working elements of the bagger, with parts broken away for clarity.

Referring to FIG. 2, there may be seen a representation of the working elements of the bagger. The figure has framework 16 which is only partially shown. It will be understood that the framework not only supports the elements of the bagger, but also forms a support for the ice maker.

The ice maker 14 freezes a preweighed quantity of water within pan or tray 18. When the ice within the tray 18 is frozen, it is immediately caused to be defrosted and the tray tilted to the position shown with solid lines in FIG. 2. The operation of the ice maker and its tilt mechanism is an integral part of the "Kold-draft" ice making machine, identified above.

At the time freezing is completed and the defrost cycle begins, an electrical relay is activated by the beginning of the defrost cycle. This relay is used to activate platen 20 which carries a plurality of bags 22. When the platen 20 reaches the position shown in dotted lines in FIG. 2, blower motor 26 connected to air fan 24 is activated. The air fan 24 will cause the top bag of the stack of bags 22 on the platen 20 to be blown open as illustrated in FIG. 2. As platen 20 reaches the position shown by the dotted lines, it automatically stops, simultaneously activating bag holder 28. The bag holder is a flap or a plate that is pivoted at shaft 30 which is at the top of the bag holder 28 when the holder is in the clamped position. The clamp is not as wide as the bag so that it will go inside the bag to hold the bag panel tightly against sealing plate 32.

The time allotted for the tray 18 to defrost is sufficient for the above sequence to occur before the ice is released. When the ice in the tray 18 is released, i.e., when the tray 18 has sufficiently defrosted to release the ice from the bottom of the pan, it slides through chute 34 into the waiting bag which is held open by the clamp 28 on one side and hooks 36 on the top of the platen 20 on the other.

At a preset time from the beginning of the defrost cycle, the tray 18 will again be returned to a horizontal position and filled with water. The freezer within the ice maker 14 will again begin to freeze the water. The electrical power which starts the freezer motor will initiate the reversal of the platen 20 to return it to the position as shown in full lines of FIG. 2.

It will be understood that when the platen 20 reverses back to its position, the holes in the bag through which the hooks 36 extend are torn out. When the platen has returned to its rest position, the beginning of the sealer drive will be initiated. I.e., the sealer chain 38 will start which will cause sealer pitman 40 to move up to the dotted position as seen in FIG. 2. This will bring sealer heater bar 42 on the end of the sealer arm 44 to a top of the filled bag. The sealer heater bar 42 will press the top of the bag against the sealer plate 32.

After the sealer heater bar 42 presses the top of the bag against the sealer plate 32, the sealer heater bar 42 is heated. The sealer bar 42 contains two elements, one of which transmits the proper amount of heat to seal the bag closed. The second, which will be above the first in the closed position, transmits sufficient heat to sever the loose portion of the bag above the seal from the seal so the two parts are severed.

After the sealer bar 42 has been heated, the power to the sealer bar 42 is shut off and the sealer drive is reversed. The chain drive 38 returns the sealer pitman 40 and sealer heater arm 44 to the full line positions as seen in FIG. 2. The bag holder 28 is returned to the original position, which is shown by the broken line position in FIG. 2.

Also, bag drop trap door 46 will be opened by the rotation of trap door arm 48 through trap door connecting link 50. When the bag drop trap door 46 opens, the sealed bag full of ice will drop into the bin 12. Of course, if the unit is mounted in a cold storage vault, the bag will drop to any receiving belt or receptacle below the bag drop trap door 46.

The bag holder 28 returns to its original position and the bag drop trap door 46 returns to its original position. The entire mechanism is returned to the original position. With everything back in its original position, nothing happens until another tray of ice begins defrosting. I.e., none of the units or motors are activated and there is no power being used by any of the motors or units of the bagger 10 until the next defrost cycle begins.

Describing the elements of the bagger in more detail, the chute 34 has long slide 52 which extends from top 54 of the bagger to the sealer plate 32. The long slide 52 extends between two side plates 56, which also slope inward so that they result in spout 58 which is less than the width of the bag 22. The ice from the tray 18 is dumped against short slide 60 which extends on the air fan 24 side of the chute 34. It will be noted that the short slide 60 terminates before the long slide 52 terminates, which means that the chute is not its smallest at this point. I have found this to be particularly important to prevent the ice from jamming in chute 34.

It will be understood that an ice jam in chute 34 can be a major problem. In this regard, I have found that having the short slide 60 attached to fan wall 62 is very helpful. Likewise, I have found it desirable to have chain loop 64 extend on the ice tray 18 to hang loosely into the chute 34. It will be seen that the chain loop will be reciprocated by the movement of the tray 18 and it is particularly useful in preventing ice from jamming.

Below the bottom of the short slide 60 is air deflector 66 which causes the air from the fan 24 to be deflected against the flap so that the two panels of the bag 22 are opened. It will be understood that the bags 22 have two panels: a perforated panel which is slightly larger so the holes therein can fit over the hooks 36, and clamped panel which is clamped by the bag holder 28.

Figure 4:
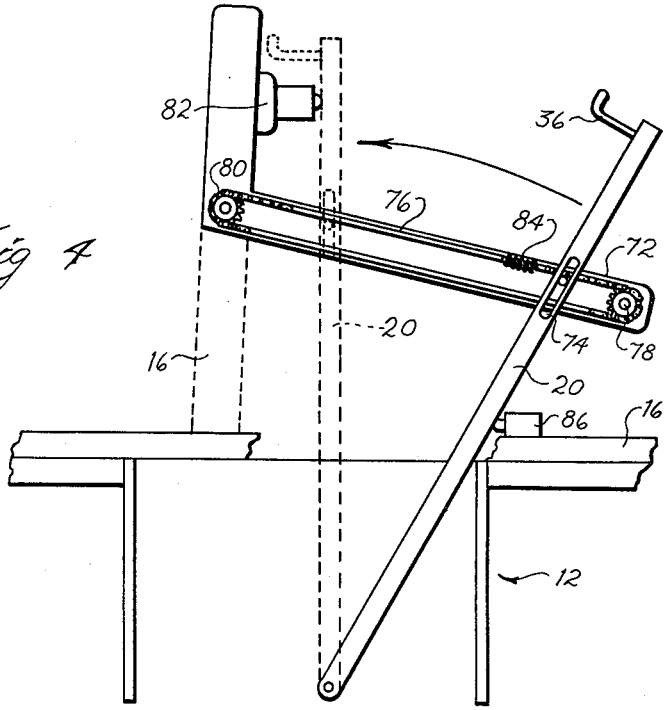
FIG. 4 is a side elevation view of the platen mechanism thereof.
Figure 3:
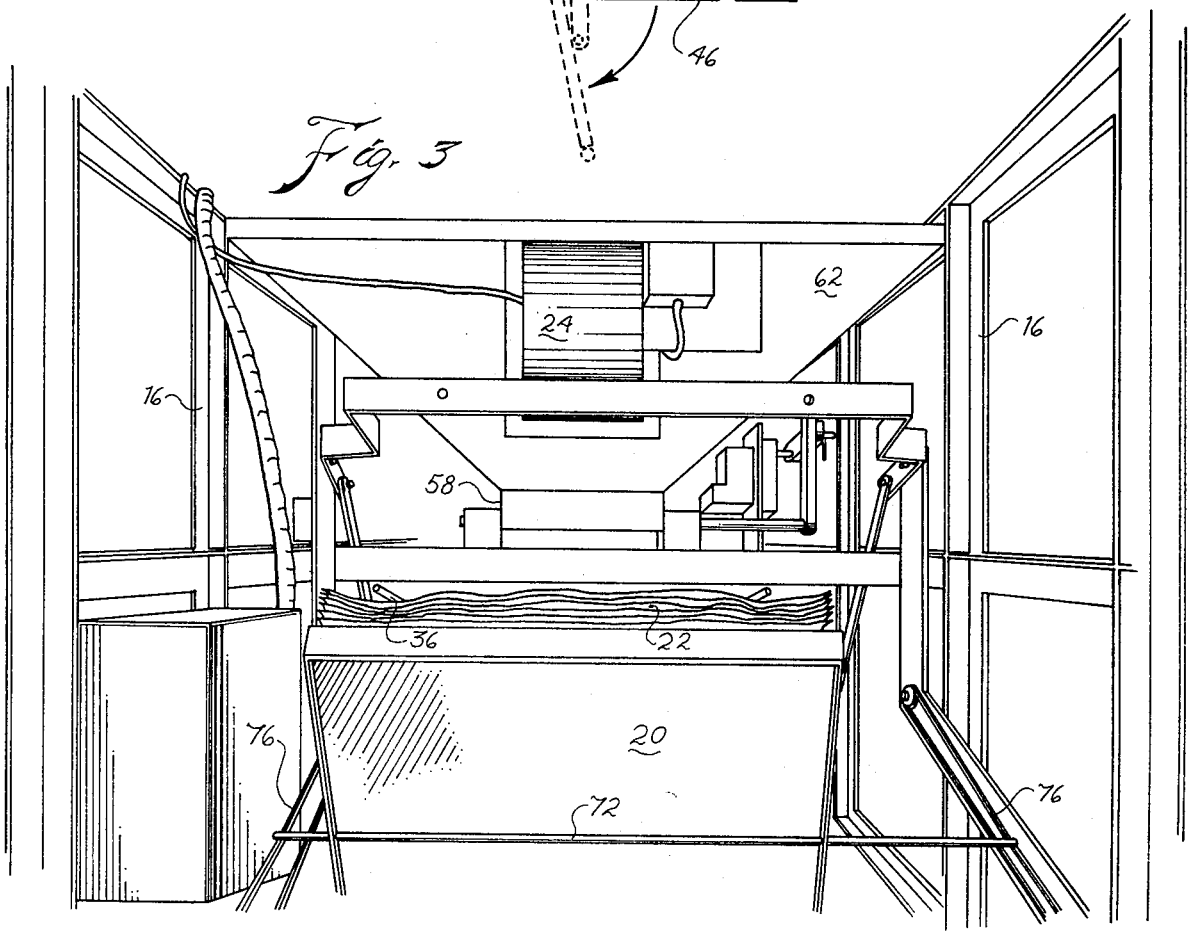
FIG. 3 is an end perspective view of my invention with the end wall removed.

The platen 20 and its actuation is shown more particularly in FIG. 3 and FIG. 4. Rod 72 extends through slot 74 in the back of the panel. The rod 72 is attached to the upper run of platen chain 76. There is a platen chain on each side of the platen 20 as seen in FIG. 3. Bag tilt motor 77 (shown only in FIG. 9) is connected to drive shaft 78. The ends of the platen chain 76 are remote from drive sprockets mounted on the bag tilt drive shaft 78. Adjacent to the chute 34 there are individual idler sprockets 80 mounted on a convenient frame member on either side of the chute 34.

As previously stated, the energization of the bag tilt motor 77 connected to the bag tilt drive shaft 78 is initiated from the defroster mechanism of the ice maker 14. It is deactivated by bag tilt forward stop micro switch 82 shown schematically in FIG. 4. Bag tilt spring 84 and the platen chain 76 provide a connection for the elements of the chain 76 and, also, provides elasticity for the chain in the event that the bag tilt motor 77 does not stop immediately.

Bag tilt forward stop microswitch 82 performs the dual funtion of stopping the bag tilt motor 77 and initiating the bag hold motor 92. Bag tilt back stop microswitch 86 is mounted at some convenient spot on the frame (schematically represented in FIG. 4) which again stops the bag tilt motor 77 when platen 20 is returned to the original position.

Figure 5:
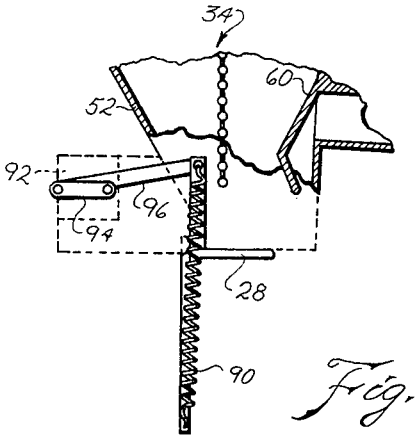
FIG. 5 is a partial side sectional view of the bag hold mechanism thereof in the open position.
Figure 6:
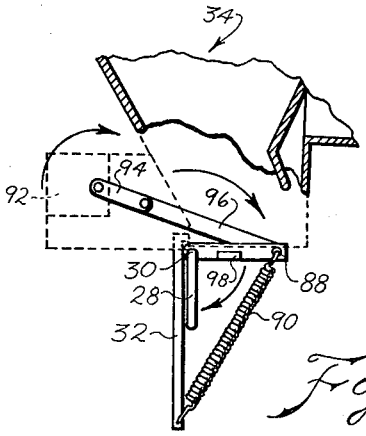
FIG. 6 is a partial side sectional view of the bag hold mechanism in the holding position.

Referring to FIGS. 5 and 6, it may be seen that bag holder 28 is actuated by arm 88 which is connected to the shaft 30. The end of arm 88 has spring 90 connected thereto. Therefore, the bag holder 28 is held firmly against the sealer plate 32 by the tension of the spring 90 and not by the bag hold motor 92. Crank arm 94 is connected to the shaft of the bag hold motor 92. Pitman 96 connects the end of the arm 88 to the crank arm 94.

As previously stated, the bag hold motor 92 is initiated by the platen 20 being in the up position and sensed by the micro switch 82. The motor 92 is stopped by bag hold mercury tilt switch 98 which is mounted upon arm 88 and is schematically shown in FIG. 6.

Figure 7:
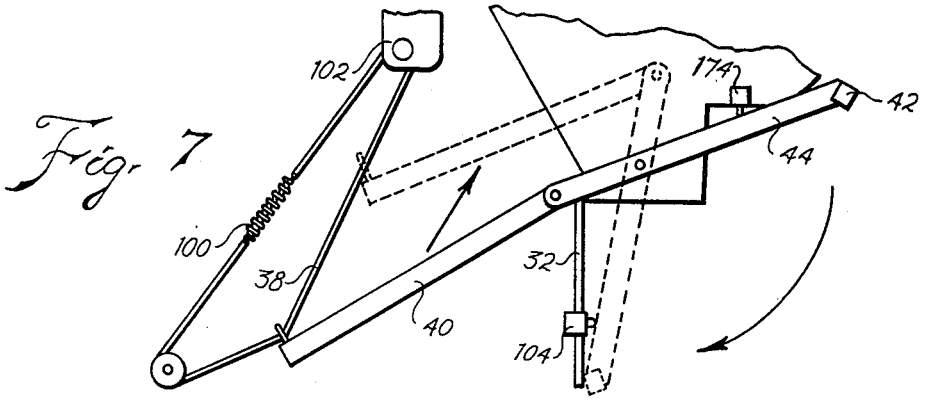
FIG. 7 is a partial side elevation view of the sealer arm mechanism of my invention.

Referring to FIG. 7, there may be seen the actuation of the sealer arm 44. It will be noted that the sealer chain 38 also has sealer spring 100 therein for the same purposes as the bag tilt spring 84 within bag tilt chain 76.

Bag tilt back stop micro switch 86 is a double-poled switch. It not only stops the bag tilt motor 77; it also initiates sealer motor 102 which drives the sealer chain 38. The sealer motor 102 is stopped by sealer reverse micro switch 104 conveniently located on or adjacent to the sealer plate 32. It is stopped when the sealer heater bar 42 is firmly against the bag against the sealer plate 32. Sealer reverse micro switch 104 is a double-pole, double-throw switch which also restarts the bag hold motor 92 to complete its revolution and bring the bag holder 28 back to its original position as seen in FIG. 5. The bag hold motor 92 is a one revolution motor which stops when it returns to the original position as seen in FIG. 5.

Figure 8:
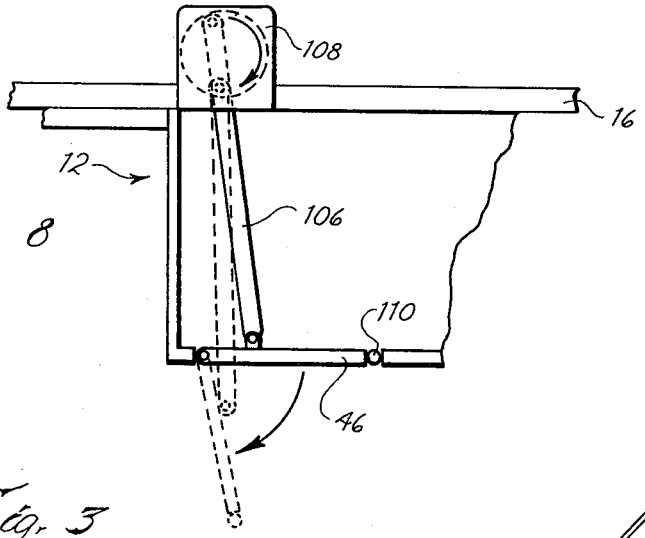
FIG. 8 is a partial side elevation view of the bag drop mechanism of my invention.

Referring to FIG. 8, there may be seen the bag drop mechanism. The bag drop trap door 46 is normally held in the up position by bag drop pitman 106 which is attached to the crank of bag drop motor 108. Full bin switch 110 is mounted in the lip of the bag drop door 46. The switch 110 will be actuated if the bin is full and the switch 110 contacts a bag of ice that has not completely fallen into the bin.

Bag switch 112 is mounted on the platen 20. This switch 112 is actuated if there are no bags located upon the platen 20.

Figure 9:
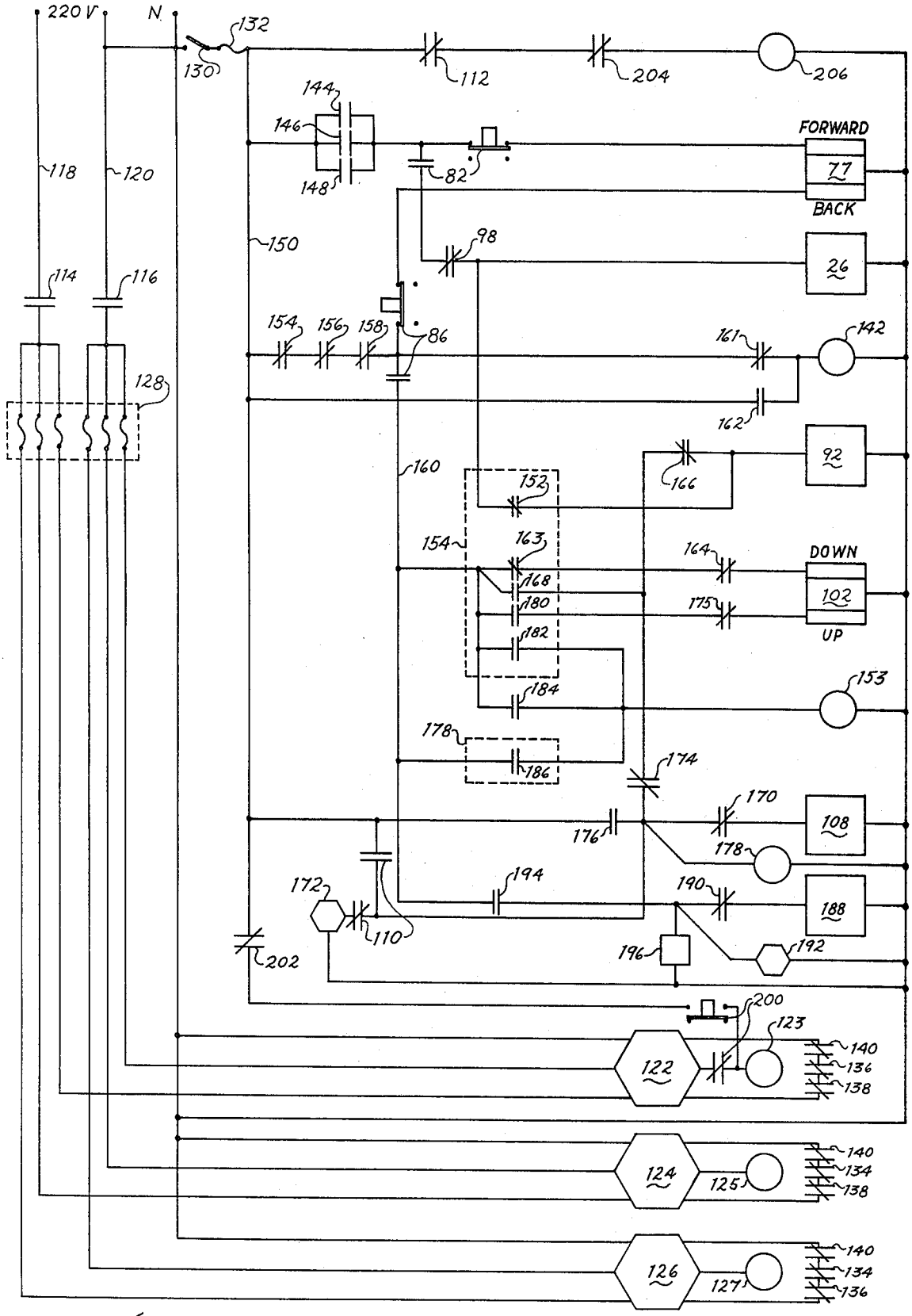
FIG. 9 is a schematic representation of the electrical system thereof.

Although it is believed that those having ordinary skill as electricians and, more particularly with regard to design or electrical control circuits, could connect the various parts of the mechanism previously described together, I have provided FIG. 9 for that purpose. All of the elements referred to in the discussion of FIG. 9 are connected as shown in FIG. 9.

In FIG. 9, power relay switches 114 and 116 connect power lines 118 and 120 to ice makers or cubers 122, 124, and 126 through a bank of fuses 128. On/off switch 130 connects power line 120 through fuse 132 to the automatic bagging circuit.

It will be understood that only one ice maker 14 or cuber has been shown in FIG. 1. However, the capacity of the bagger is such that it will bag ice from at least three cubers. It is possible to stack each of the cubers, which have been designated on the schematic as 122, 124, and 126, in vertical series. All that is necessary is that the chutes from the upper two cubers direct ice to the chute 34 as seen in FIG. 2. However, novel deactivation circuits are needed to prevent two ice makers from dumping ice into the bagger at the same time.

In FIG. 9 each of the cubers 122, 124, and 126 are activated by control relays 123, 125 and 127, respectively, which are thermostatically controlled relays described heretofore which initiate the defrost cycle of each cuber. Each of the cubers 122, 124 and 126 are interconnected to prevent the initiation of a defrost cycle for two or more cubers simultaneously or the initiation of a defrost cycle while a bagging cycle is in progress. I accomplish this by connecting two of the cuber control switches 134, 136 and 138 controlled by the control relays 123, 125 and 127 and bagger control switch 140 controlled by bagging circuit control relay 142 in series to the defrost initiation circuit.

The switch 140 is shown connected in series with two of the switches 134, 136, and 138 to the defrost initiation circuit. The two switches 134, 136 and 138 connected to each cuber are controlled by the control relays of the other two cubers, i.e. control relay 123 of cuber 122 controls switch 134 and control relay 125 of cuber 124 controls switch 136. Each of the switches 134 through 140 are in the normally closed position. If one of the relays 122, 124, 126 or 142 are activated, the switches 134 through 140, respectively, will be opened, thereby deactivating the defrost initiation circuit of the cubers.

Bag tilt control switches 144, 146 and 148 controlled by the control relays 123, 125, and 127, respectively, are connected in parallel between bagger bus line 150 and the bag tilt forward stop microswitch 82. Microswitch 82 is located on the bag tilt forward position of the framework, as previously described. The normally closed contacts of the switch 82 are connected to the forward rotation connection of reversible bag tilt motor 77. The normally open contacts of the switch 82 are also connected through the normally closed bag hold mercury tilt switch 98 to the blower motor 26 and through normally closed reversing relay switch 152 to bag hold motor 92.

Sealer control switches 154, 156 and 158, controlled by the control relays 123 through 127 are connected in series such that the opening of any of these switches by activation of one of the control relays 123 through 127 will disconnect power from the bag tilt back stop microswitch 86. The normally closed side of the back stop microswitch 86 is connected to the back rotation connection of the reversible bag tilt motor 77. The normally open connection of the switch 86 provides a connection of power to sealer bus line 160.

The control relay 142 is connected directly to the sealer control switches 154 through 158 through normally closed bag hold up switch 161 controlled by the self contained switch in the one revoltuion bag hold motor 92 previously described. The bagging circuit control relay 142 is also connected to the bus line 150 through normally open bag drop switch 162 controlled by a self contained switch in the one revolution bag drop motor 108 previously described.

The down connection of the reversible sealer drive motor 102 is connected to the sealer bus line 160 through normally closed relay switch 163 controlled by relay 153 and normally closed bag hold up switch 164 also controlled by the self contained switch in the one revolution bag hold motor 92. The bag hold motor 92 is connected to the sealer bus line 160 through normally closed bag hold up switch 166, controlled by the same switch as switch 164, and normally open relay switch 168 controlled by the relay 153.

The bag drop motor 108 is connected to the sealer bus line 160 through normally closed timed bag drop switch 170, controlled by time delay relay 172, sealer up switch 174 and relay switch 168. The bag drop motor 108 is also connected to the bus line 150 through normally open bag drop switch 176 controlled by the self contained switch which controls switch 162. Switch 174 is connected to the frame such that when the sealer arm 44 is in the up position, the switch 174 will be opened. (FIG. 7.). Bagger control relay 178 and the time delay relay 172 are connected in the same manner as the bag drop motor 108. The up connection of the reversible sealer motor 102 is connected to the sealer bus line 160 through normally closed sealer drive switch 175, controlled by switch 174, and normally open relay switch 180, controlled by relay 154.

The bagger control relay 153 is connected to the sealer bus line 160 through three switches: relay switch 182 which is controlled by relay 154, sealer down switch 184 which is controlled by the switch 104, and relay switch 186 which is controlled by the bagger contact relay 178. Seal transformer 188 (shown only in FIG. 9) provides power to sealer heater bar 42 and is connected to the sealer bus line 160 through normally closed timed seal switch 190, controlled by time delay relay 192, and normally open sealer up switch 194 controlled by the switch 174. Counter 196 and the time delay relay 192 are connected to the bus line 160 in the same way as the seal transformer 188.

The full bin switch 110 is interposed between the time delay relay 172 and the connection to the switches 176 and 174.

I have provided a test circuit for simulating a defrost cycle by connecting the control relay 123 to power through test switch 200 and relay switch 202 controlled by the control relay 142. The switch 200 is normally open to the switch 202 and normally closed to the cuber 122. When the switch 200 is depressed, the cuber 122 defrost circuit is open and the test switch 200 circuit through the relay switch 202 controlled by control relay 142 is closed.

With the circuit assembled as described above and in FIG. 9, the following sequence of events may be seen to occur when a defrost cycle is initiated by one of the cubers. Assume that a defrost cycle is initiated by the activation of the control relay 123 of the cuber 122, or by depressing test switch 200. Simultaneously, the switches 144 and 154 controlled by the control relay 123 will close and open respectively. Power will be supplied through the switch 82 which will be normally closed to the forward connection of the reversible bag tilt motor 77. The platen 20 will tilt forward until it contacts the switch 82 thereby disconnecting power to the bag tilt motor 77, and stopping it.

Power will be connected through the normally closed side of the switch 82 and through the switch 98 to the blower motor 26 and to the bag hold motor 92 through the normally closed switch 152. The bag holder 28 will move to the down position at which time the switch 98 will be open, thereby disconnecting power from the blower 26 and the bag hold motor 92. This situation will exist for the duration of the defrost cycle with the bag being held open by the bag holder 28 and ice placed within the bag.

Additionally, during the defrost cycle discussed above, the switch 134 controlled by the activated control relay 123 of the cuber 122 was open, thereby preventing the initiation of defrost cycles by the cubers 124 and 126. In this way simultaneous discharges of ice into the bagger 10 from the other cubers is prevented during the defrost cycle of a single cuber.

When the defrost cycle has been completed, the control relay 123 will deactivate, thereby opening the switch 144 and closing the switch 154. Power will flow through the switch 112 to activate the control relay 142, which controls the switch 140. The switch 140 will be opened, thereby preventing the initiation of defrost cycles by any of the cubers. The control relay will remain activated until the bagging cycle is completed, thereby insuring that malfunctions will result in a halting of the defrosting process, and that ice is not dumped into the bagger during a bagging cycle.

Power will also flow through the closed switch 86 to the back connection of the reversible bag tilt motor 77. The bag tilt motor 77 will operate until the platen 20 contacts the switch 86, thereby disconnecting power to the bag tilt motor 77 and connecting power to the sealer bus line 160. Simultaneously, the down connection of the sealer drive motor 102 will be connected to power through the normally closed switches 164 and 163. The sealer motor 102 will move the sealer arm 44 downward until it reaches the fully down position, at which time the switch 104 will be activated, thereby closing the switches 184 and 194.

The closing of the switch 194 connects power through the switch 190 controlled by the time delay relay 92 to the sealer transformer 188. The sealer transformer will supply power to the sealer heater bar 142, thereby sealing the bag. When the power is supplied through the switch 194, the counter 196 will record the sealing of an additional bag. The time delay relay will disconnect the power from the sealer transformer after a preset delay interval. This delay interval is shorter in duration than the time it takes the sealer reverse mechanism to begin to raise the sealer arm 44 from the sealing plate, 32.

The closing of the switch 184 will connect power to the relay 153, thereby opening the switches 152 and 162 and closing the switches 168, 180, and 182. The closing of the switch 168 will supply power through the closed switch 166 to the bag hold motor 92, which will cause the bag holder 28 to move upward. Likewise, the closing of the switch 168 will connect power to the closed switch 174. From the switch 174, power will be connected to the bag drop motor 108 through the closed switch 170 to the relay 178 and to the time delay relay 172 through the closed switch 198, as shown in FIG. 9. The connection of power to the relay 178 will cause the switch 186 to be closed, thereby supplying power to the relay 153 and maintaining the switches 168, 180 and 182 in the closed position.

The closing of the switch 180 will connect power through the switch 175 to the up connection of the sealer drive motor 102. The sealer drive motor 102 will cause the sealer arm 44 to move upward. The sealer arm deactivates the switch 104 when it moves away from the sealing plate 32, thereby opening switches 184 and 194. As previously described, the seal transformer 188 has been disconnected from power by the time delay relay 192 before the switch 194 is opened. However, the opening of the switch 194 prevents the seal transformer from being connected to power in the event of a malfunction in the time delay relay 192. This provides added safety in preventing a fire, etc. from being started by the unfortunate situation of having power supplied to the sealer heater bar 42 when the sealer arm 44 is in the up position.

At the time relay 153 is activated and relay switch 168 is closed the bag hold motor 92 is started, which brings the bag holder 28 to the up position. The self contained switch in the bag hold motor 92 then stops the motor 92 and opens the switches 161 and 164.

At the time the bag drop motor 108 is started, the switch 176 will close, thereby supplying power to the bag drop motor 108. This will open the bag drop trap door 46 and allow the filled bag to drop through as previously described. During the interval in which the bag drop motor is operating, the internal switch in the bag drop one revolution motor will be activated, thereby closing switch 176. Also during the operation of the bag drop motor, the sealer arm 44 will move to the up position, thereby contacting switch 174 and opening it. Therefor, until the bag drop trap door 46 is again in the up position, the switch 176 will remain closed and will be the only power to the bag drop motor 108. When the bag drop trap door 46 is in the up position, the switch 176 will be opened, thereby stopping the bag drop motor 108, and completing the entire bagging cycle. At this point, all the elements described are in their original positions.

For the duration of the time the switch 176 is closed, the switch 162, controlled by the internal switch in the bag drop motor, will also be closed. Once the bag hold motor 92 has been stopped by the self contained switch previously described, the switch 161 controlled by the same selfcontained switch will be open. Therefore, when the bag drop trap door is again in the up position, the power to the control relay 142 will be disconnected, thereby deactivating the control relay 142, closing the switch 140 on the cuber defrost initiation circuits, and allowing the initiation of the next defrost cycle.

The safety features noted before, namely the out-of-bags switch 112 and the full bin switch 110 are located in the circuit supplying power to the power relay 206, which controls the switch 114. The full bin switch 110 is connected to the time delay relay 172 which controls delay switch 204. If power is supplied to the time delay relay 172, the switch 204 is opened, thereby disconnecting power from the power relay 206 and opening the switch 114.

Likewise, should the platen 20 run out of bags, the switch 112 will be opened, thereby disconnecting power from the power relay 206 and opening the switch 114. It is important to note that by connecting the safety features to the power source for the cubers rather than to the bagging circuitry, the bagging sequence for the last bag may be completed.

In order to test the bagging system as noted before, the switch 200 is depressed thereby supplying current to the control relay 123 and closing the switch 144. The switch 200 may be held down to observe movement of the platen and the actuation of the blower and bag holder motors; switch 200 may then be released to simulate the end of the defrost cycle and an observation of the sealer cycle to completion.

Therefore, it may be seen that I have invented a greatly improved automatic bagging system for packaging ice in hermetically sealed bags that requires little or no attention from an operator and increases the utility and efficiency of ice makers.

As an aid to correlating the terms of the claims to the exemplary drawing, the following catalog of elements is provided:

| | | | |
|---|---|---|---|
| 10 | ice bagger | 72 | rod |
| 12 | bin | 74 | slot |
| 13 | doors | 76 | platen chain |
| 14 | ice maker | 77 | bag tilt motor |
| 16 | framework | 78 | bag tilt drive shaft |
| 18 | tray | 80 | idler sprockets |
| 20 | platen | 82 | bag tilt fwd stop microswitch |
| 22 | bags | 84 | bag tilt spring |
| 24 | air fan | 86 | bag tilt back stop microswitch |
| 26 | blower motor | 88 | arm |
| 28 | bag holder | 90 | spring |
| 30 | shaft | 92 | bag hold motor |
| 32 | sealing plate | 94 | crank arm |
| 34 | chute | 96 | pitman |
| 36 | hooks | 98 | bag hold mercury tilt switch |
| 38 | sealer chain | 100 | sealer spring |
| 40 | sealer pitman | 102 | sealer motor |
| 42 | sealer heater bar | 104 | sealer reverse microswitch |
| 44 | sealer arm | 106 | bag drop switch |
| 46 | bag drop trap door | 108 | bag drop motor |
| 48 | trap door arm | 110 | full bin switch |
| 50 | trap door cntng link | 112 | out-of-bags switch |
| 52 | long slide | 114 | power relay switch |
| 54 | top of bagger | 116 | power relay switch |
| 56 | side plates | 118 | power line |
| 58 | spout | 120 | power line |
| 60 | short slide | 122 | cuber |
| 62 | fan wall | 123 | control relay |
| 64 | chain loop | 124 | cuber |
| 66 | air deflector | 125 | control relay |
| 126 | cuber | 164 | bag hold up switch |
| 127 | control relay | 166 | bag hold up switch |
| 128 | fuse bank | 168 | relay switch |
| 130 | on/off switch | 170 | timed bag drop switch |
| 132 | fuse | 172 | time delay relay |
| 134 | cuber control switch | 174 | sealer up switch |
| 136 | cuber control switch | 175 | sealer up switch |
| 138 | cuber control switch | 176 | bag drop switch |
| 140 | bagger control switch | 178 | bagger control relay |
| 142 | bagger control relay | 180 | relay switch |
| 144 | bag tilt control sw. | 182 | relay switch |
| 146 | bag tilt control sw. | 184 | sealer reverse switch |
| 148 | bag tilt control sw. | 186 | relay switch |
| 150 | bagger bus line | 188 | seal transformer |
| 152 | relay switch | 190 | timed seal switch |
| 153 | bagger control relay | 192 | time delay relay |
| 154 | sealer control switch | 194 | sealer up switch |
| 156 | sealer control switch | 196 | counter |
| 158 | sealer control switch | 200 | test switch |
| 160 | sealer bus line | 202 | relay switch |
| 161 | bag hold up switch | 204 | timed bin switch |
| 162 | bag drop switch | 206 | power relay |
| 163 | relay switch | | |

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. The method of preparing a bag of ice comprising:
a. freezing water into ice in the tray,
b. dumping the ice from the tray directly into a heat sealable bag,.
c. sealing the bag closed,
d. dumping the ice through a chute,
e. carrying a plurality of bags by a panel of each of the bags stacked on a movable platen,
f. moving the platen with the bags to the chute,
g. opening the bag and
h. attaching another panel of the bag to the chute, then
j. performing said dumping step, then
k. moving the platen away from the chute, and
m. performing said sealing step.

2. The invention as defined in claim 1 further comprising:
n. dumping the ice from at least two trays, and
o. delaying said dumping step unless the ice may by received in an available bag.

3. The invention as defined in claim 1 with an additional limitation of
n. tearing the bag panel loose from the platen when the platen moves away.

4. The invention as defined in claim 3 wherein said ice is released from the pan wherein it is frozen by defrosting said pan,
o. said platen movement to the chute is initiated by the beginning of the defrosting,
p. said attaching a panel to the chute is responsive to the panel being under the chute,
q. said platen movement away is initiated by the resumption of freezing ice in the pan,
r. sealing the bag responsive to the platen moving away from the chute,
s. releasing said panel from the chute responsive to complete sealing, and
t. dropping the bag responsive to releasing of the panel.

5. The invention as defined in claim 3 wherein
q. said ice is released from the pan wherein it is frozen by defrosting said pan,
r. said platen movement to the chute is initiated by the beginning of the defrosting,
s. said attaching a panel to the chute is responsive to the panel being under the chute,
t. said platen movement away is initiated by the resumption of freezing ice in the pan,
u. sealing the bag responsive to the platen moving away from the chute, and
v. releasing said panel from the chute responsive to complete sealing and
w. dropping the bag responsive to releasing of the panel.

6. The invention as defined in claim 5 wherein the opening of the bag is accomplished by
x. a blower blowing air into the bag.

7. In an ice preparation mechanism for bagging ice in a bag having two panels, said mechanism having
a. an ice making machine which is means for
(i) freezing a preset weight of water and
(ii) dumping the ice when frozen, and
b. a cold storage space;
the improved structure for bagging the ice comprising in combination with the above:
c. a frame,
d. a chute mounted on the frame and forming means for receiving the ice as it is dumped,
e. a platen mounted for movement on the frame,
f. a plurality of bags mounted on the platen,
g. means for moving the platen with the bags thereon to the chute before ice is dumped from the ice making machine,
h. a clamp on the frame below the chute for clamping one of the panels of the bag beneath the chute,
j. a trap door in an opening in the top of the cold storage bin below the chute, and
k. means on the frame for heat-sealing the bag after the ice is dumped therein and before the trap door opens.

8. The invention as defined in claim 7 wherein said said chute including
(i) a long slide on one side, said long slide having a planar surface and terminating at the bottom at
(ii) a spout,
(iii) a short slide in the chute opposite the long slide, said short slide beginning below the top of the long slide, and said short slide terminating above the bottom of the long slide,
(iv) the configuration of the chute below the short slide angling back away from a vertical plane, said width of the spout being at least as wide as the space between the end of the short slide and the end of the long slide so that the narrowest restriction within the chute occurs at the termination of the long slide.

9. The invention as defined in claim 7 wherein said ice making mechanism also including
n. a tray which tilts toward the chute downward when dumping the ice, and further comprising:
j. a chain extending from the tray into the chute,
k. so that said chain reciprocates each time ice is dumped from the tray, thereby clearing any ice jam within the chute.

10. The invention as defined in claim 9 wherein said chute includes
(i) a long slide on one side, said long slide having a planar surface and terminating at the bottom at
(ii) a spout,
(iii) a short slide in the chute, opposite the long slide, said short slide beginning below the top of the long slide, and said short side terminating above the bottom of the long slide,
(iv) the configuration of the chute below the short slide angling back away from a vertical plane, said width of the spout being at least as wide as the space between the end of the short slide and the end of the long slide so that the narrowest restriction within the chute occurs at the termination of the long slide.

11. An ice preparation mechanism for bagging ice in a bag having two panels, said mechanism having
a. an ice making machine which is means for
(i) freezing a preset weight of water and
(ii) dumping the ice when frozen, and
b. a cold storage space;

the improved structure for bagging the ice comprising in combination with the above:

c. a frame, d. a chute mounted on the frame and forming a means for receiving the ice as it is dumped from the ice making mechanism, said chute having (i) a long slide on one side, said long slide having a planar surface and terminating at the bottom at (ii) a spout, (iii) a short slide in the chute opposite the long slide, said short slide beginning below the top of the long slide and said short slide terminating above the bottom of the long slide, (iv) the configuration of the chute below the short slide angling back away from a vertical plane, said width of the spout being at least as wide as the space between the end of the short slide and the end of the long slide so that the narrowest restriction within the chute occurs at the termination of the long slide, and e. bagging means on the frame below the chute for bagging the ice.

12. The invention as defined in claim 11 wherein said ice making mechanism also including a tray which tilts toward the chute downward when dumping the ice, f. a chain extending from the tray into the chute, g. so that said chain reciprocates each time ice is dumped from the tray, thereby clearing any ice jam within the chute.

13. An ice preparation mechanism for bagging ice in a bag having two panels, said mechanism having, an ice making machine which is means for freezing a preset weight of water and dumping the ice when frozen, and a cold storage space;

the improved structure for bagging the ice comprising in combination with the above:

a. a frame, b. a chute mounted on the frame being a means for receiving the ice as it is dumped from the ice making mechanism, c. said ice making mechanism also including a tray which tilts toward the chute downward when dumping the ice, d. a chain extending from the tray into the chute, e. so that said chain reciprocates each time ice is dumped from the tray, thereby clearing any ice jam within the chute.

14. The invention as defined in claim 7 further comprising:

h. at least two of said means for freezing, j. deactivation means for delaying the initiation of dumping of the ice unless said bagging mechanism is in a condition to receive the ice.

15. The invention as defined in claim 11 further comprising:

f. at least two of said means for freezing, g. deactivation means for delaying the initiation of dumping of the ice unless said bagging mechanism is in a condition to receive the ice.

16. The invention as defined in claim 13 further comprising:

f. at least two of said means for freezing, g. deactivation means for delaying the initiation of dumping of the ice unless said bagging mechanism is in a condition to receive the ice.

* * * * *